US006595174B2

(12) United States Patent
Schnell

(10) Patent No.: US 6,595,174 B2
(45) Date of Patent: Jul. 22, 2003

(54) SWITCHING ELEMENT FOR A VALVE TRAIN OF AN INTERNAL COMBUSTION ENGINE

(75) Inventor: Oliver Schnell, Veitsbronn (DE)

(73) Assignee: Ina-Schaeffler KG (DE)

( * ) Notice: Subject to any disclaimer, the term of this patent is extended or adjusted under 35 U.S.C. 154(b) by 0 days.

(21) Appl. No.: 10/246,230

(22) Filed: Sep. 18, 2002

(65) Prior Publication Data

US 2003/0051689 A1 Mar. 20, 2003

(30) Foreign Application Priority Data

Sep. 19, 2001 (DE) ..... 101 46 131

(51) Int. Cl.[7] ..... F01L 1/14

(52) U.S. Cl. ..... 123/90.55; 123/90.16; 123/90.48; 123/90.52; 74/569

(58) Field of Search ..... 123/90.55, 90.16, 123/90.35, 90.45–90.5, 90.52–90.53; 74/569

(56) References Cited

U.S. PATENT DOCUMENTS 6,039,017 A * 3/2000 Hendriksma ..... 123/90.43
6,164,255 A * 12/2000 Maas et al. ..... 123/90.16

FOREIGN PATENT DOCUMENTS

| | | |
|---|---|---|
| DE | 9403420 | 3/1994 |
| DE | 4442965 | 6/1996 |
| DE | 19838926 | 3/2000 |
| DE | 19844202 | 3/2000 |
| EP | 1143120 | 10/2001 |
| EP | 1149989 | 10/2001 |
| WO | 9530081 | 11/1995 |

* cited by examiner

*Primary Examiner*—Thomas Denion
*Assistant Examiner*—Kyle Riddle
(74) *Attorney, Agent, or Firm*—Muserlian, Lucas and Mercanti

(57) ABSTRACT

The invention proposes a switching element (1) for a valve train of an internal combustion engine, said switching element comprising an outer element (2) and an inner element (4) that is arranged for axial displacement in a bore (3) of the outer element (2), each of the outer element (2) and the inner element (4) comprising at least one reception (12, 9) aligned to each other in an axially distant relative position which is achieved through a lost motion spring (8), at least one piston (10) being arranged in at least one of the receptions (12, 9) for sliding toward the other of the receptions (12, 9) to couple the inner element (4) to the outer element (2) in said relative position, and a high-position stop for defining said relative position being arranged between the inner element (4) and the outer element (2). The inventive high-position stop is made as a separate element (16) such as a disk or a circlip with a variable thickness that is fixed on one of the outer element (2) and the inner element (4) and cooperates with a stop surface of the other of the outer element (2) and the inner element (4). These extremely simple fabrication measures enable an alignment of the receptions (9, 12) for achieving coupling.

7 Claims, 1 Drawing Sheet

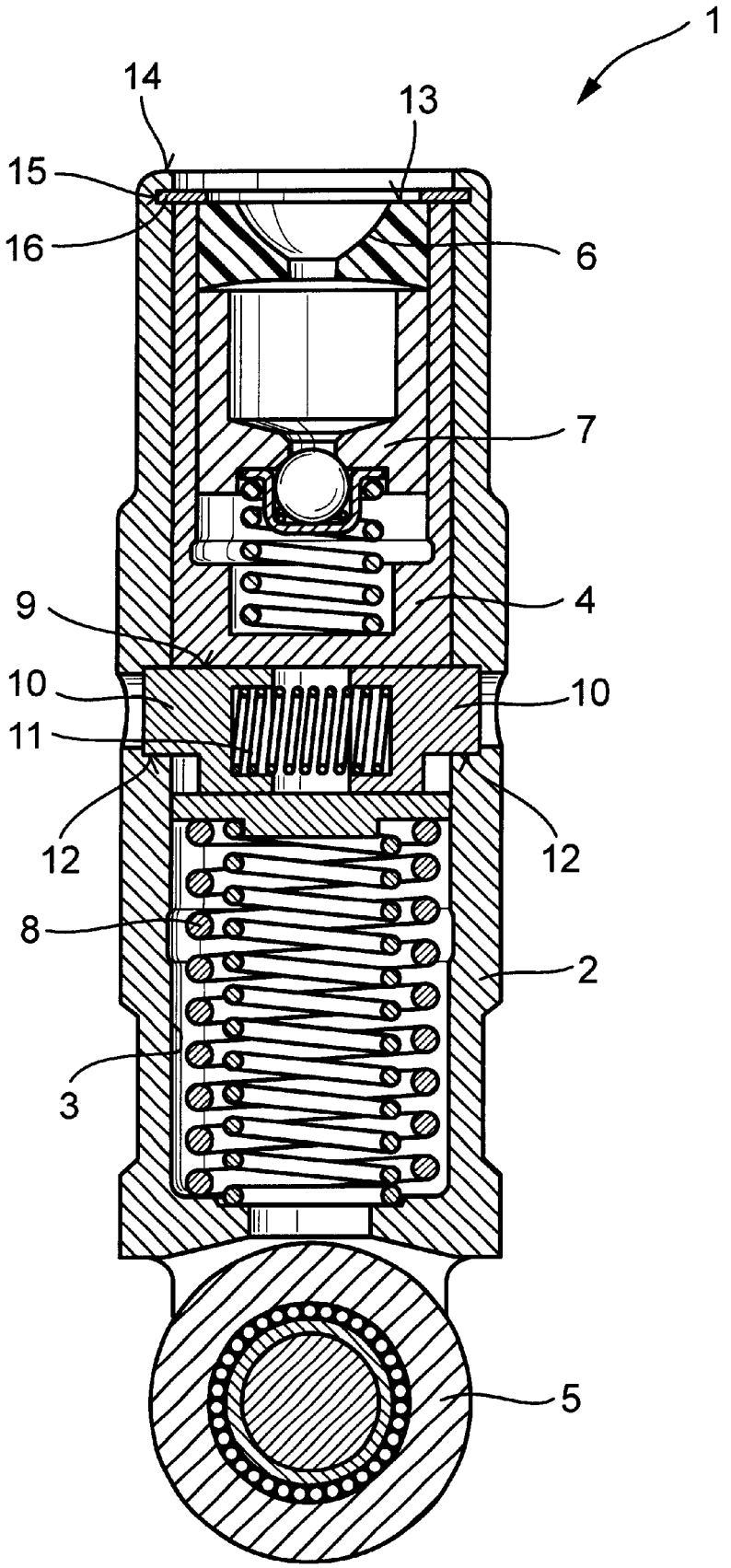
1
14
13
15
16
6
7
9
4
10
10
11
12
12
8
2
3
5

SWITCHING ELEMENT FOR A VALVE TRAIN OF AN INTERNAL COMBUSTION ENGINE

FIELD OF THE INVENTION

The invention concerns a switching element for a valve train of an internal combustion engine, preferably for valve deactivation, said switching element comprising an outer element and an inner element that is arranged for axial displacement in a bore of the outer element, each of the outer element and the inner element comprising at least one reception aligned to each other in an axially distant relative position which is achieved through a lost motion spring, at least one piston being arranged in at least one of the receptions for sliding toward the other of the receptions to couple the inner element to the outer element in said relative position, and a high-position stop for defining said relative position being arranged between the inner and the outer element.

BACKGROUND OF THE INVENTION

A switching element of the pre-cited type is disclosed in the generic prior art document DE 199 15 531 which shows a switchable cam follower for a tappet push rod drive. The high-position stop for defining the relative position is formed by a piston-like element arranged in the inner element. This piston-like element projects radially outward into a longitudinal groove of the outer element. In the axially extracted state of the inner element from the outer element, the piston-like element abuts against one end of the longitudinal groove. The purpose of this is to create an aligned arrangement of a coupling bore made in the outer element for a piston arranged in the inner element for achieving coupling.

A drawback of this prior art is that an adjustment of lash in the coupling is relatively complicated and cost-intensive. It is clear that the reception (coupling bore) in the outer element for receiving the piston must be configured with a slight lash relative to the outer peripheral surface of the piston. This lash and the high position differ from switching element to switching element due to fabrication conditions. The relatively wide range of variance of this mechanical idle travel in switching elements is, however, undesirable.

Therefore, to keep the coupling lash or its variance within acceptable limits, pistons to be used for coupling are sorted into groups. This procedure is extremely expensive from the point of view of fabrication and measuring techniques. For example, the switching elements are first completely mounted, the lash is then measured following which, the switching elements are dismounted again and an appropriate piston is then chosen for coupling. It is equally conceivable to group the high-position stops provided on the longitudinal grooves of the outer elements.

If, as disclosed in DE 42 06 166, two pistons are used for coupling, the stop measures described above prove to be quasi impossible. The aligned position of the coupling bores that are situated diametrically opposite each other in the inner element is realized by the contact of the two axially displaceable parts of the switching element on the base circle of the cam. From the point of view of fabrication and measuring techniques, the adjustment of the lash of the coupling is implemented in an extremely complicated and expensive manner by a pairing of corresponding switching elements (in this case, cup tappets to cam pairs or cam shafts). Under certain circumstances, a too large variation of lash will have to be allowed.

OBJECTS OF THE INVENTION

It is an object of the invention to provide an improved switching element of the pre-cited type in which the aforesaid drawbacks are eliminated by simple measures.

This and other objects and advantages of the invention will become obvious from the following detailed description.

SUMMARY OF THE INVENTION

The invention achieves the above objects by the fact that the high-position stop is made as a separate element of variable thickness such as a disk or a circlip that is fixed on one of the outer element and the inner element and cooperates with a stop surface of one of the inner element and the outer element. In a particularly advantageous embodiment of the invention, coupling is achieved by two pistons that extend diametrically opposite each other in the reception of the inner element, which reception is made as a radial bore, said pistons being aligned to the receptions of the outer element in the relative position.

The separate element of the invention disposed, for example, in the bore of the outer element, forms a simple, tilt-free and adjustable high-position stop. The initially described drawbacks are thus eliminated by simple measures. During a mounting of the switching element (disk, circlip or the like), different thicknesses of the separate element can be chosen to adjust the mechanical idle travel of the at least one coupling element (preferably two) relative to the reception in which it is arranged. This means in other words, that in the axially extracted state of the inner element from the outer element, the annular high-position stop enables the axes of the receptions and the axes of the pistons to be aligned or adjusted to one another for achieving coupling. In place of a variation of the thickness of the separate element, the height of the inner element with its end face may also be varied.

The scope of protection of the invention extends explicitly to all types of switching elements in valve trains such as cam followers in tappet push rod drives, cup tappets and support elements for finger levers. The invention extends likewise to switching elements that are installed directly in lever-type cam followers. The switching elements may be designed for complete de-actuation or for switching to different cam lifts.

According to a further feature of the invention, the separate element serves at the same time as a safety device against loss and for transportation. In this way, additional securing measures that may possibly have to be removed prior to mounting the switching element in the internal combustion engine can be dispensed with.

The invention will now be described more closely with reference to the appended drawing.

BRIEF DESCRIPTION OF THE DRAWING

The sole FIGURE shows, in a longitudinal section, a switching element of the invention made in the present case as a roller tappet for a tappet push rod drive.

DETAILED DESCRIPTION OF THE DRAWING

The FIGURE discloses a switching element 1 that is configured as a roller tappet. The switching element is designed for switching to different valve lifts, in, the present case, for switching between a zero lift and a full lift. The switching element 1 comprises an outer element 2 in whose recess 3 an inner element 4 is received for axial displacement.

On one end, the switching element 1 comprises a roller 5 for contacting a cam and acts at the opposite end through a support 6 on a tappet push rod in lifting direction. In the present example, the support 6 is a part of a hydraulic lash adjuster 7.

A lost motion spring 8 that does not need to be described here, acts axially between the inner element 4 and the outer element 2. The inner element 4 comprises a radially extending cylindrical reception 9 in which two pistons 10 situated diametrically opposite each other are received for coupling the inner element 4 to the outer element 2. The pistons 10 are biased radially outward by the force of a compression spring 11. In the relative position of the inner element 4 to the outer element 2 shown in the FIGURE, receptions 12 in the outer element 2 are situated opposite the pistons 10. For coupling, the pistons 10 can be displaced partially into the receptions 12 by the force of the compression spring 11.

In the maximum relative position of the inner element 4 to the outer element 2 shown in the FIGURE, the end face 13 of the inner element 4 does not project beyond the end face 14 of the outer element 2 that is directed toward the tappet push rod. In the vicinity of the end face 14, the bore 3 of the outer element 2 comprises an annular groove 15. An element 16 that defines a high-position stop for the inner element 4 in the uncoupled state is arranged in this annular groove 15. In the present embodiment, the element 16 is configured as a disk. Thus, the end face 13 of the inner element 4 serves as a stop surface on the element 16.

As described in detail above, it is possible with the element 16 of variable thickness, to realize in a very simple manner from the fabrication point of view, an alignment of the pistons 10 to the receptions 12 in the outer element 2. For achieving this, during the mounting of the element 16, after this has been previously measured, its thickness is chosen so that the pistons 10, of course in the unloaded state of the switching element, are surrounded by the receptions 12 uniformly and with slight lash upon coupling. The axes of the pistons 10 are aligned to the axes of the receptions 12. In this way, an idle travel that the inner element 4 undergoes with the pistons 10 in the receptions 12 relative to the outer element 2 upon coupling to the outer element 2 and at the onset of loading by the cam is uniformly small throughout a series of switching elements 1 in internal combustion engines of the same time. An excessive and undesired variance of the valve timing is excluded.

What is claimed is:

1. A switching element typically used for valve deactivation in a valve train of an internal combustion engine, said switching element comprising an outer element and an inner element that is arranged for axial displacement in a bore of the outer element, each of the outer element and the inner element comprising at least one reception aligned to each other in an axially distant relative position which is achieved through a lost motion spring, at least one piston being arranged in at least one of the receptions for sliding toward the other of the receptions to couple the inner element to the outer element in said relative position, and a high-position stop for defining said relative position being arranged between the inner and the outer element, wherein the high-position stop is made as a separate element of variable thickness that is fixed on one of the outer element and the inner element and cooperates with a stop surface of the other of the outer element and the inner element.

2. A switching element of claim 1, wherein the switching element is made as a cam follower in a tappet push rod drive, an end face of the inner element does not project beyond an end face of the outer element that is directed toward the tappet push rod, the bore of the outer element comprises an annular groove in which the separate element is fixed, and the separate element projects into the bore of the outer element so that, in the relative position, the end face of the inner element bears as a stop surface against the separate element.

3. A switching element of claim 1, wherein coupling is achieved by two pistons that extend diametrically opposite each other in the reception of the inner element, which reception is made as a radial bore, said pistons being aligned to the receptions of the outer element in the relative position.

4. A switching element of claim 2, wherein coupling is achieved by two pistons that extend diametrically opposite each other in the reception of the inner element, which reception is made as a radial bore, said pistons being aligned to the receptions of the outer element in the relative position.

5. A switching element of claim 1, wherein the separate element also serves as a safety device for the inner element relative to the outer element.

6. A switching element of claim 1, wherein the separate element of variable thickness is a disk.

7. A switching element of claim 1, wherein the separate element of variable thickness is a circlip.

* * * * *